US007436125B2

(12) United States Patent
Mashiko

(10) Patent No.: US 7,436,125 B2
(45) Date of Patent: Oct. 14, 2008

(54) LIGHT EMITTING DIODE DRIVE CIRCUIT

(75) Inventor: Takeshi Mashiko, Chiba (JP)

(73) Assignee: Seiko Instruments Inc., Chiba (JP)

( * ) Notice: Subject to any disclaimer, the term of this patent is extended or adjusted under 35 U.S.C. 154(b) by 32 days.

(21) Appl. No.: 11/435,408

(22) Filed: May 17, 2006

(65) Prior Publication Data

US 2006/0261747 A1 Nov. 23, 2006

(30) Foreign Application Priority Data

May 20, 2005 (JP) ..... 2005-147453

(51) Int. Cl.
*H05B 37/02* (2006.01)

(52) U.S. Cl. ..... 315/224; 315/294; 315/307

(58) Field of Classification Search ..... 323/222, 323/234, 282, 265, 266; 315/192, 294, 224, 315/308, 307

See application file for complete search history.

(56) References Cited

U.S. PATENT DOCUMENTS

| | | | | |
|---|---|---|---|---|
| 5,515,261 | A * | 5/1996 | Bogdan | 363/89 |
| 6,466,188 | B1 | 10/2002 | Cato | |
| 2005/0110469 | A1 * | 5/2005 | Inaba et al. | 323/222 |

* cited by examiner

*Primary Examiner*—Shawn Riley
(74) *Attorney, Agent, or Firm*—Brinks Hofer Gilson & Lione

(57) ABSTRACT

Provided is an LED drive circuit capable of controlling a current caused to flow through an LED at a proper value even when a power supply voltage is higher than a sum of a forward voltage of the LED to be driven and a voltage of a current sense element. In a configuration where an inductor and a rectifying element are connected in series to each other, at each one terminal thereof and the LED and a current sense element, which are connected in series to each other, are a smoothing capacity are respectively connected to the other terminals of the inductor and the rectifying device, in parallel with each other, the LED and these elements are separated from a power supply or a ground by a switching element.

4 Claims, 7 Drawing Sheets

LIGHT EMITTING DIODE DRIVE CIRCUIT

This application claims priority under 35 U.S.C. §119 to Japanese Patent Application No. 2005-147453 filed May 20, 2005, the entire content of which is hereby incorporated by reference.

BACKGROUND OF THE INVENTION

1. Field of the Invention

The present invention relates to a light emitting diode drive circuit having a DC-DC converter circuit for driving a light emitting diode (hereinafter referred to as "LED") at a constant current.

2. Description of the Related Art

As a common DC-DC converter circuit for driving an LED at a constant current, a booster circuit shown in FIG. 2 is widely known.

A smoothing capacity 104 is connected between a rectifying device 103 and a ground (GND). In addition, a switching element 105 is connected between a connecting point at which an inductor 102 and the rectifying device 103 are connected to each other, and the ground. An LED 108 and a current sense element 107 are connected in series to each other between a connecting point at which the rectifying device 103 and the smoothing capacity 104 are connected to each other, and the ground. Further, an output of the current sense element 107 is connected to a control circuit 106, and an output of the control circuit 106 is connected to the switching element 105.

The control circuit 106 monitors a voltage of the current sense element 107, and controls short-circuiting and open-circuiting of the switching element 105, thereby controlling a current caused to flow through the LED 108 at a proper value to cause the LED to emit light properly. In other words, in order to cause a proper current to flow through the LED 108, a voltage of the smoothing capacity 104 is controlled so that the voltage becomes a sum of a forward voltage when a proper current is caused to flow through the LED 108, and a voltage generated when a proper current is caused to flow through the current sense element 107.

However, in driving an LED in the boost DC-DC converter circuit shown in FIG. 2, there is a problem in that, when a power supply voltage is increased to be higher than a forward voltage of the LED to be driven, a current flowing through the LED cannot be controlled.

In other words, provided that a voltage generated at the time when a current is caused to flow through the rectifying device 103, is set to 0 V, when a voltage of a power supply 101 exceeds a sum of a forward voltage generated due to a proper current caused to flow through the LED 108 and a voltage generated due to a proper current caused to flow through the current sense element 107, a current caused to flow through the LED 108 and the current sense element 107 each are increased to be larger than a proper value. As a result, the LED emits light excessively, and at worst, the LED may break down.

SUMMARY OF THE INVENTION

In order to solve the above-mentioned problem with the conventional art, the present invention therefore has an object to provide a technique for causing a proper current to flow through an LED even when a power supply voltage is increased to be a high voltage.

In order to solve the above-mentioned problem, the present invention provides a structure in which an inductor and a rectifying device are connected in series to each other, and an LED and a current sense element, which are connected in series to each other at each one terminal thereof, and a smoothing capacity are respectively connected to the other terminal of the inductor and the rectifying device, in parallel with each other.

According to the present invention, it is possible to cause a proper current to flow through an LED even when a power supply voltage is a high voltage in driving the LED in a DC-DC converter circuit. Further, when a switching element is turned off, a power supply voltage is not applied to the LED and the current sense element, thereby making it possible to reduce current consumption without providing another switching element.

DESCRIPTION OF THE PREFERRED EMBODIMENTS

First Embodiment

Figure 1:
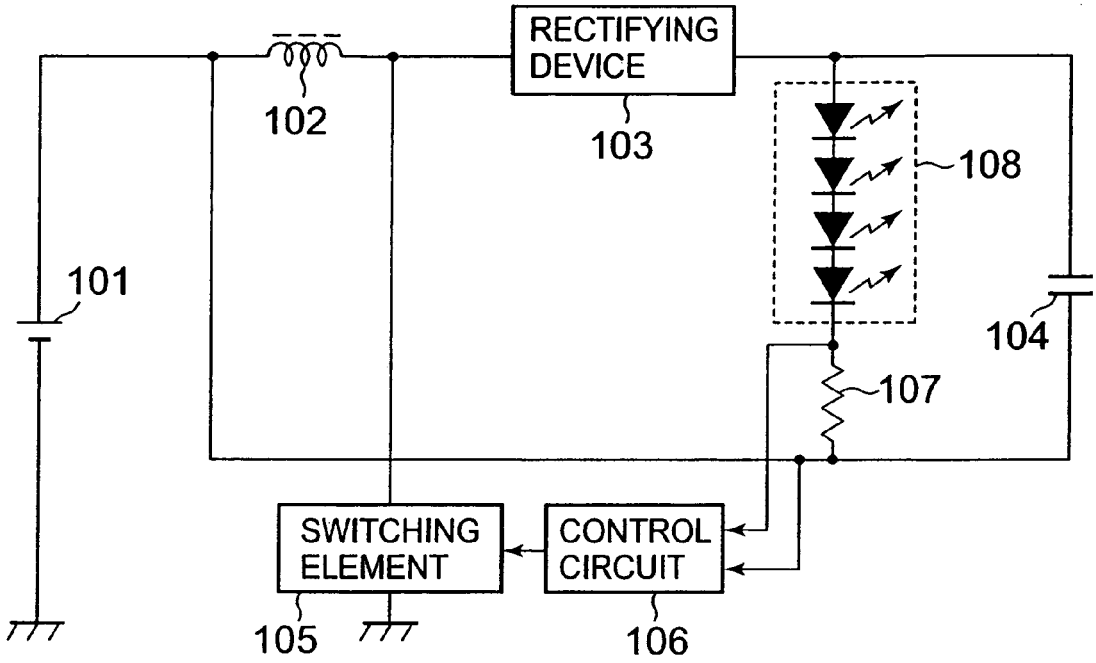
FIG. 1 is a diagram showing an LED drive circuit according to a first embodiment of the present invention.
Figure 2:
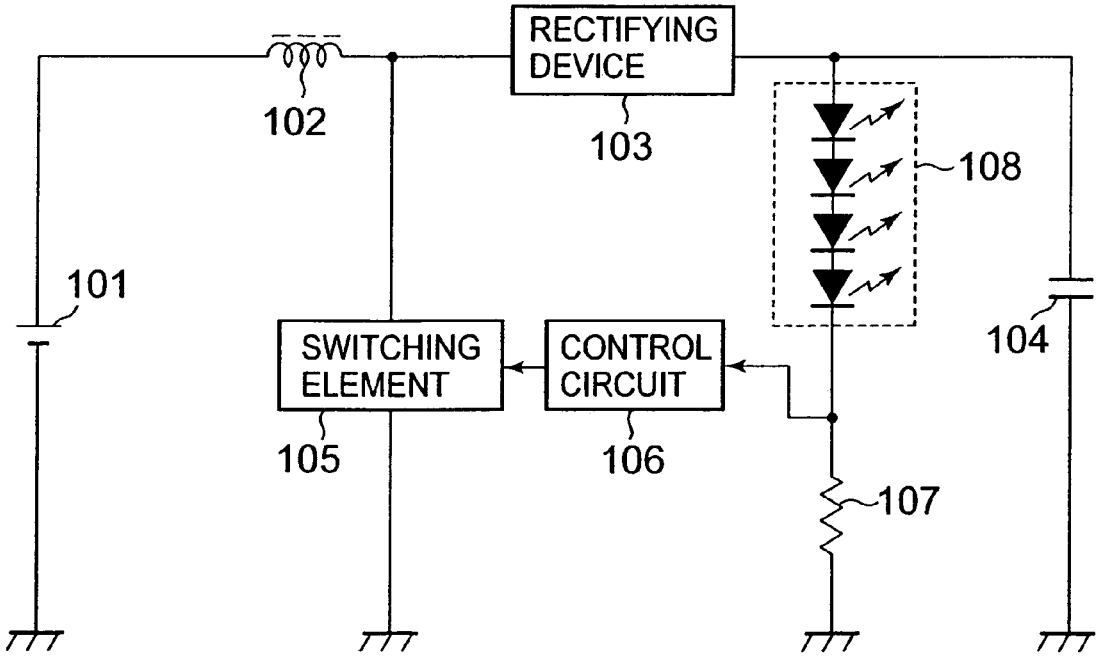
FIG. 2 PRIOR ART
FIG. 2 is a diagram showing a conventional LED drive circuit.

FIG. 1 is a circuit diagram according to a first embodiment of the present invention. An inductor 102 and a rectifying device 103 are connected in series with a power supply 101, and a smoothing capacity 104 is connected in parallel with the inductor 102 and the rectifying device 103. An LED 108 is connected to a connecting point at which the rectifying device 103 and the smoothing capacity 104 are connected to each other, one terminal of a current sense element 107 is connected to the other terminal of the LED 108, and the other terminal of the current sense element 107 is connected to the power supply 101. A control circuit 106 is connected to both terminals of the current sense element 107, a switching element 105 is connected between a connecting point at which the inductor 102 and the rectifying device 103 are connected to each other, and a ground, and an output of the control circuit 106 is connected to the switching element 105.

A feature of the first embodiment resides in that the smoothing capacity 104, and the LED 108 and the current sense element 107 which are connected in series to each other, are connected in parallel with each other at both terminals each of the inductor 102 and the rectifying device 103 which are connected in series to each other. With such a configuration, when the switching element 105 is short-circuited, the inductor 102 is charged with electric power, and then the switching element 105 is open-circuited, the electric power of the inductor 102 emits directly to the LED 108, the current sense element 107, and the smoothing capacity 104 through the rectifying device 103, thereby making it possible to drive the LED 108 irrespective of a voltage of the power supply 101.

Accordingly, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Second Embodiment

Figure 3:
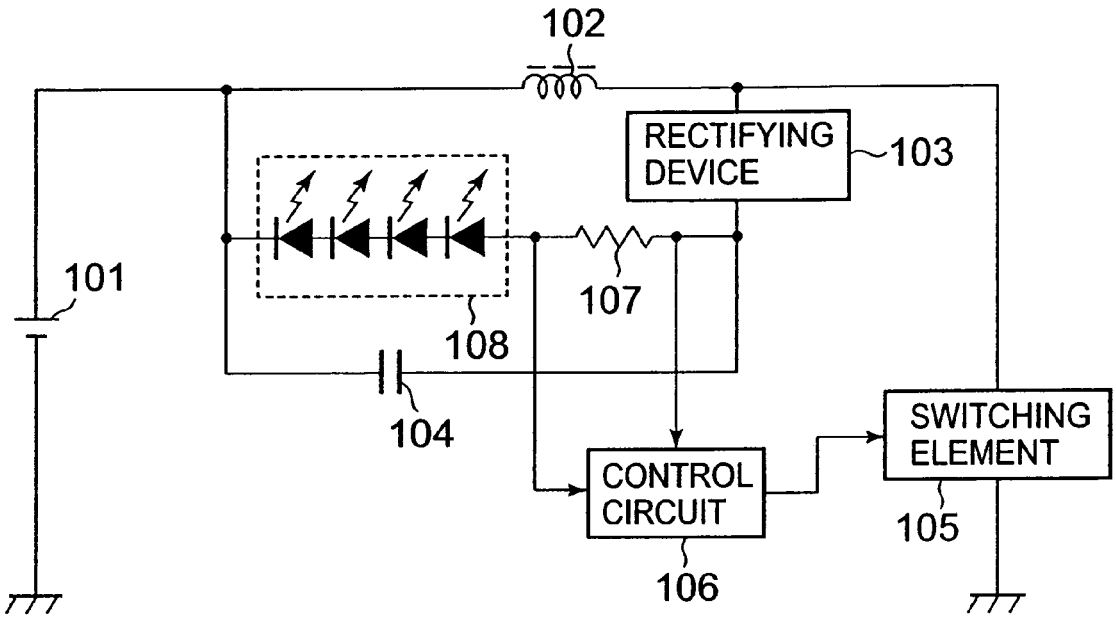
FIG. 3 is a diagram showing an LED drive circuit according to a second embodiment of the present invention.

FIG. 3 is a circuit diagram according to a second embodiment of the present invention. The second embodiment is different from the first embodiment in that the LED 108 and the current sense device 107 are exchanged.

The circuit according to the second embodiment has a configuration in which the power supply 101 is connected to one terminal of the inductor 102, the other terminal of the inductor 102 is connected to one terminal of the rectifying device 103, the other terminal of the rectifying device 103 is connected to one terminal of the smoothing capacity 104, and the other terminal of the smoothing capacity 104 is connected to the power supply 101. A connecting point at which the inductor 102 and the rectifying device 103 are connected to each other, is connected to one terminal of the switching element 105, and the other terminal of the switching element 105 is connected to the ground. In the switching element 105, short-circuiting and open-circuiting are repeated, thereby causing the inductor 102 to charge/discharge electric power to cause the smoothing capacity 104 to generate a voltage through the rectifying device 103. Further, one terminal of the current sense element 107 is connected to a connecting point at which the rectifying device 103 and the smoothing capacity 104 are connected to each other, the other terminal of the current sense element 107 is connected to one terminal of the LED 108, and the other terminal of the LED 108 is connected to the power supply 101, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 3 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Third Embodiment

Figure 4:
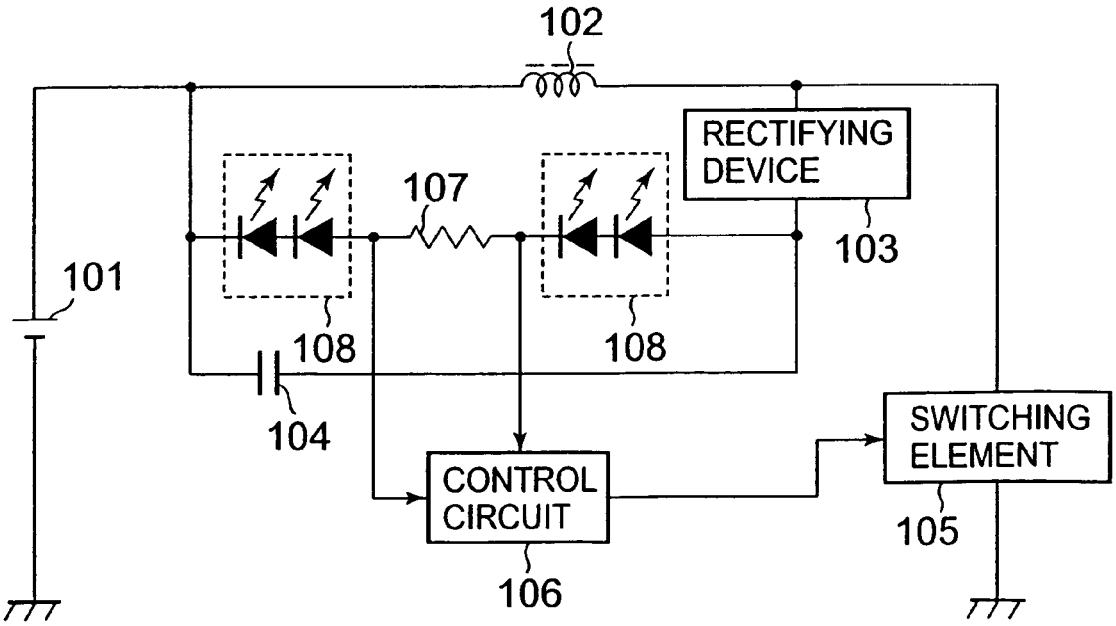
FIG. 4 is a diagram showing an LED drive circuit according to a third embodiment of the present invention.

FIG. 4 is a circuit diagram according to a third embodiment of the present invention. The third embodiment is different from the first embodiment in that the current sense element 107 is placed between the LEDs 108.

The circuit according to the third embodiment has a configuration in which the power supply 101 is connected to one terminal of the inductor 102, the other terminal of the inductor 102 is connected to one terminal of the rectifying device 103, the other terminal of the rectifying device 103 is connected to one terminal of the smoothing capacity 104, and the other terminal of the smoothing capacity 104 is connected to the power supply 101. A connecting point at which the inductor 102 and the rectifying device 103 are connected to each other, is connected to one terminal of the switching element 105, and the other terminal of the switching element 105 is connected to the ground. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the rectifying device 103 and the smoothing capacity 104 are connected to each other, is connected to one terminal of one of the LEDs 108, the other terminal of one of the LEDs 108 is connected to one terminal of the current sense 107, the other terminal of the current sense 107 is connected to one terminal of the other of the LEDs 108, and the other terminal of the other of the LEDs 108 is connected to the power supply 101, thereby making it possible to drive the LEDs 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 4 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Fourth Embodiment

Figure 5:
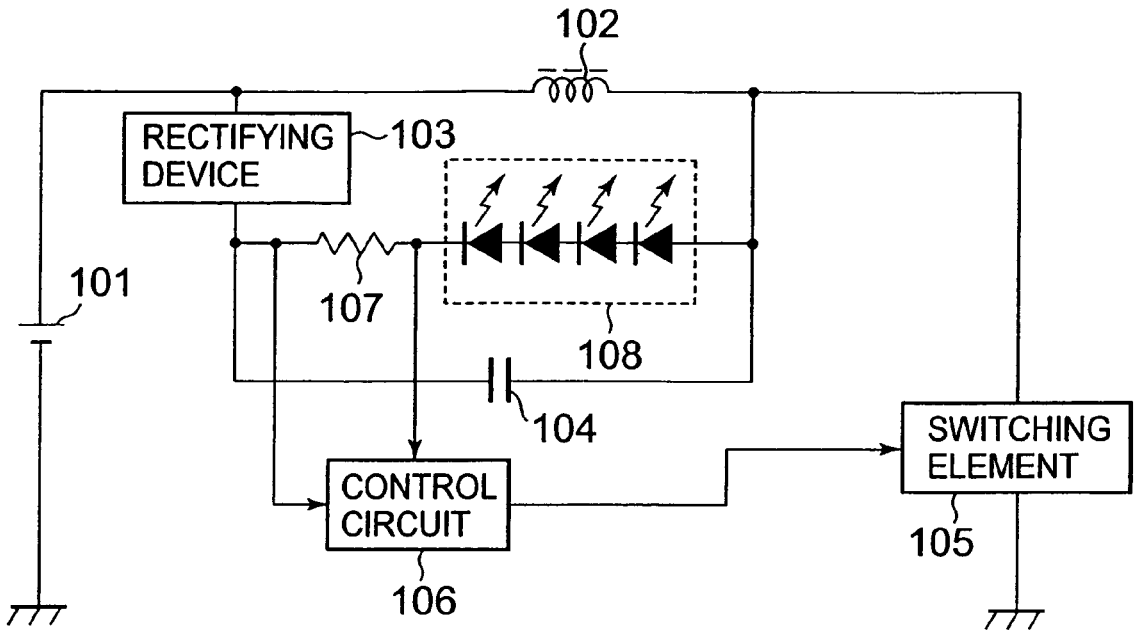
FIG. 5 is a diagram showing an LED drive circuit according to a fourth embodiment of the present invention.

FIG. 5 is a circuit diagram according to a fourth embodiment of the present invention. The fourth embodiment is different from the first embodiment in a position in which the rectifying device 103 is inserted. That is, the rectifying device 103 is inserted between a connecting point at which the inductor 102 and the power supply 101 are connected to each other, and a connecting point at which the smoothing capacity 104 and the current sense element 107 are connected to each other.

The circuit according to the fourth embodiment has a configuration in which the power supply 101 is connected to one terminal of the inductor 102, the other terminal of the inductor 102 is connected to one terminal of the smoothing capacity 104, the other terminal of the smoothing capacity 104 is connected to one terminal of the rectifying device 103, and the other terminal of the rectifying device 103 is connected to the power supply 101. A connecting point at which the inductor 102 and the smoothing capacity 104 are connected to each other, is connected to one terminal of the switching element 105, and the other terminal of the switching element 105 is connected to the ground. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the inductor 102 and the smoothing capacity 104 are connected to each other, is connected to one terminal of the LED 108, the other terminal of the LED 108 is connected to one terminal of the current sense element 107, and the other terminal of the current sense element 107 is connected to a connecting point at which the rectifying device 103 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 5 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Fifth Embodiment

Figure 6:
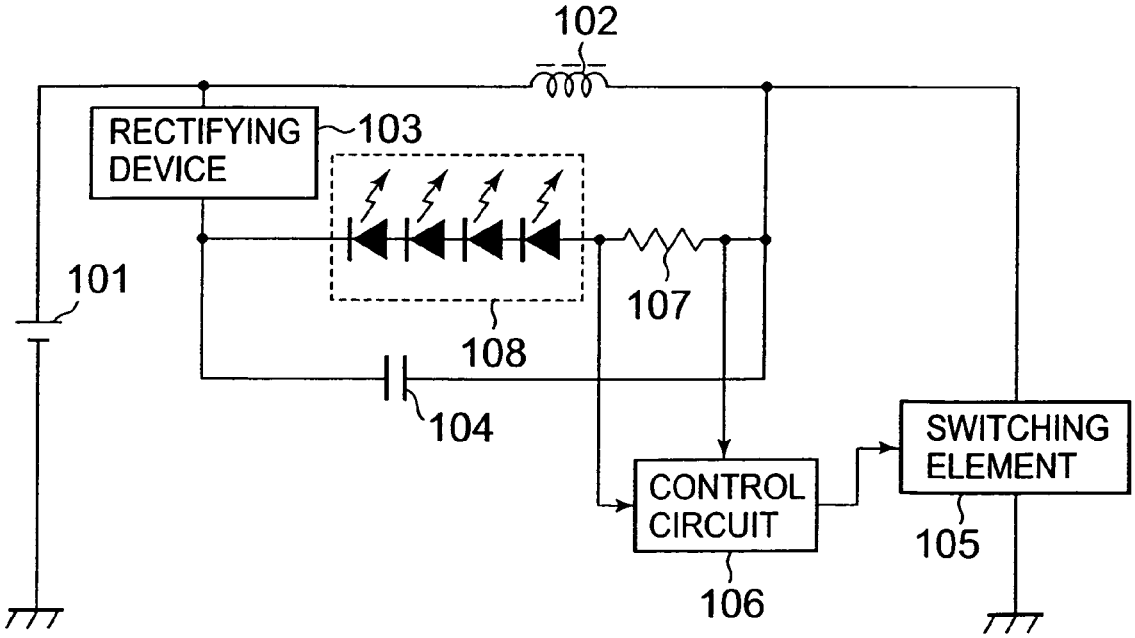
FIG. 6 is a diagram showing an LED drive circuit according to a fifth embodiment of the present invention.

FIG. 6 is a circuit diagram according to a fifth embodiment of the present invention. The fifth embodiment is different from the second embodiment in a position in which the rectifying device 103 is inserted. That is, the rectifying device 103 is inserted between a connecting point at which the inductor 102 and the power supply 101 are connected to each other, and a connecting point at which the smoothing capacity 104 and the LED 108 are connected to each other.

The circuit according to the fifth embodiment has a configuration in which the power supply 101 is connected to one terminal of the inductor 102, the other terminal of the inductor 102 is connected to one terminal of the smoothing capacity 104, the other terminal of the smoothing capacity 104 is connected to one terminal of the rectifying device 103, and the other terminal of the rectifying device 103 is connected to the power supply 101. A connecting point at which the inductor 102 and the smoothing capacity 104 are connected to each other, is connected to one terminal of the switching element 105, and the other terminal of the switching element 105 is connected to the ground. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the inductor 102 and the smoothing capacity 104 are connected to each other, is connected to one terminal of the current sense element 107, the other terminal of the current sense element 107 is connected to one terminal of the LED 108, and the other terminal of the LED 108 is connected to a connecting point at which the rectifying device 103 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 6 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current is caused to flow through the LED 108 and a voltage generated due to the current sense element 107, it is possible to cause a proper current to flow without making the LED 108 to emit light excessively.

Sixth Embodiment

Figure 7:
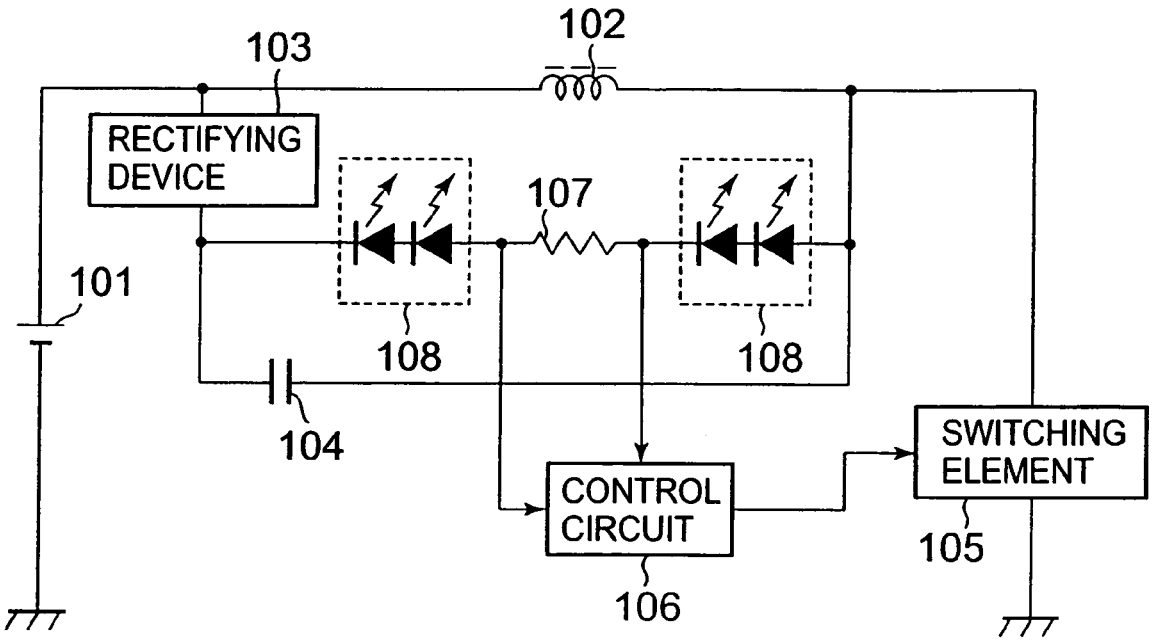
FIG. 7 is a diagram showing an LED drive circuit according to a sixth embodiment of the present invention.

FIG. 7 is a circuit diagram according to a sixth embodiment of the present invention. The sixth embodiment is different from the third embodiment in a position in which the rectifying device 103 is inserted. That is, the rectifying device 103 is inserted between a connecting point at which the inductor 102 and the power supply 101 are connected to each other, and a connecting point at which the smoothing capacity 104 and the LED 108 are connected to each other.

The circuit according to the sixth embodiment has a configuration in which the power supply 101 is connected to one terminal of the inductor 102, the other terminal of the inductor 102 is connected to one terminal of the smoothing capacity 104, the other terminal of the smoothing capacity 104 is connected to one terminal of the rectifying device 103, and the other terminal of the rectifying device 103 is connected to the power supply 101. A connecting point at which the inductor 102 and the smoothing capacity 104 are connected to each other, is connected to one terminal of the switching element 105, and the other terminal of the switching element 105 is connected to the ground. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the inductor 102 and the smoothing capacity 104 are connected to each other, is connected to one terminal of one of the LEDs 108, the other terminal of one of LEDs 108 is connected to one terminal of the current sense element 107, the other terminal of the current sense element 107 is connected to one terminal of the other of the LEDs 108, and the other terminal of the other of the LEDs 108 is connected to a connecting point at which the rectifying device 103 and the smoothing capacity 104 are connected to each other, thereby making it possible to drive the LEDs 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 7 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current is caused to flow through the LED 108 and a voltage generated due to a proper current caused to flow through the current sense element 107, it is possible to cause a proper current to flow without making the LED 108 to emit light excessively.

Seventh Embodiment

Figure 8:
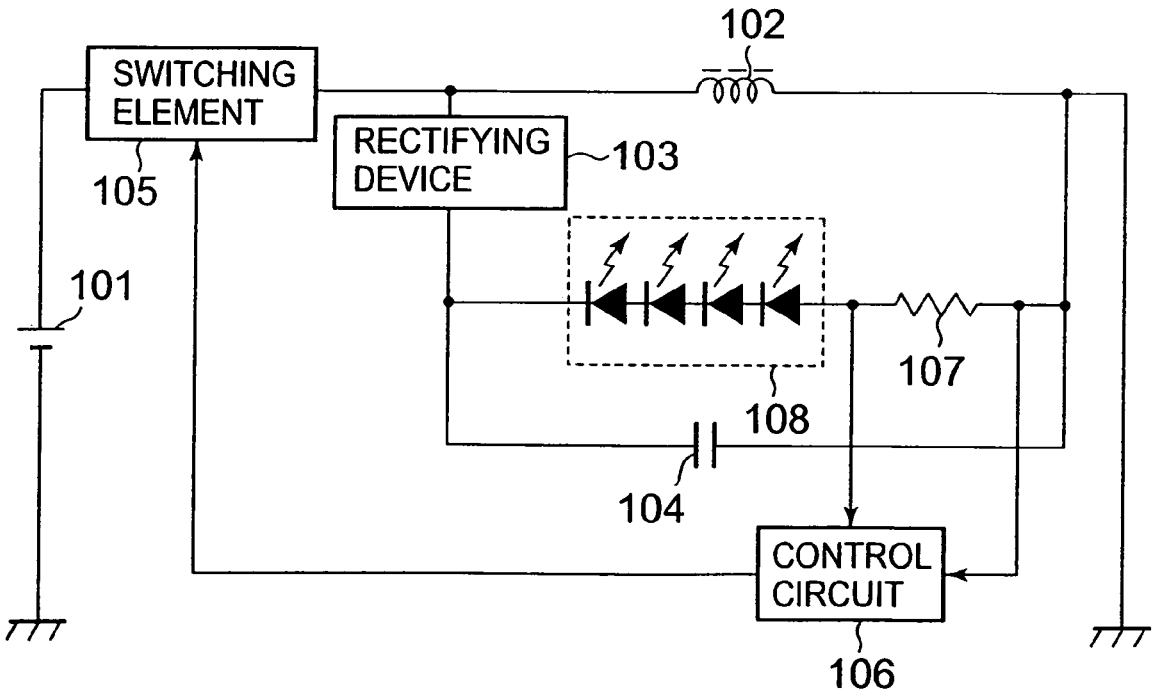
FIG. 8 is a diagram showing an LED drive circuit according to a seventh embodiment of the present invention.

FIG. 8 is a circuit diagram according to a seventh embodiment of the present invention. The seventh embodiment is different from the fifth embodiment in a position in which the switching element 105 is inserted. That is, the switching element 105 is inserted between the power supply 101 and a connecting point at which the inductor 102 and the smoothing capacity 104 are connected to each other.

The circuit according to the seventh embodiment has a configuration in which the ground is connected to one terminal of the inductor 102, the other terminal of the inductor 102 is connected to one terminal of the rectifying device 103, the other terminal of the rectifying device 103 is connected to one terminal of the smoothing capacity 104, and the other terminal of the smoothing capacity 104 is connected to the ground. The power supply 101 is connected to one terminal of the switching element 105, the other terminal of the switching element 105 is connected to a connecting point at which the inductor 102 and the rectifying device 103 are connected to each other. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the inductor 102 and the smoothing capacity 104 are connected to each other, is connected to one terminal of the current sense element 107, the other terminal of the current sense element 107 is connected to one terminal of the LED 108, the other terminal of the LED 108 is connected to a connecting point at which the rectifying device 103 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 8 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Eighth Embodiment

Figure 9:
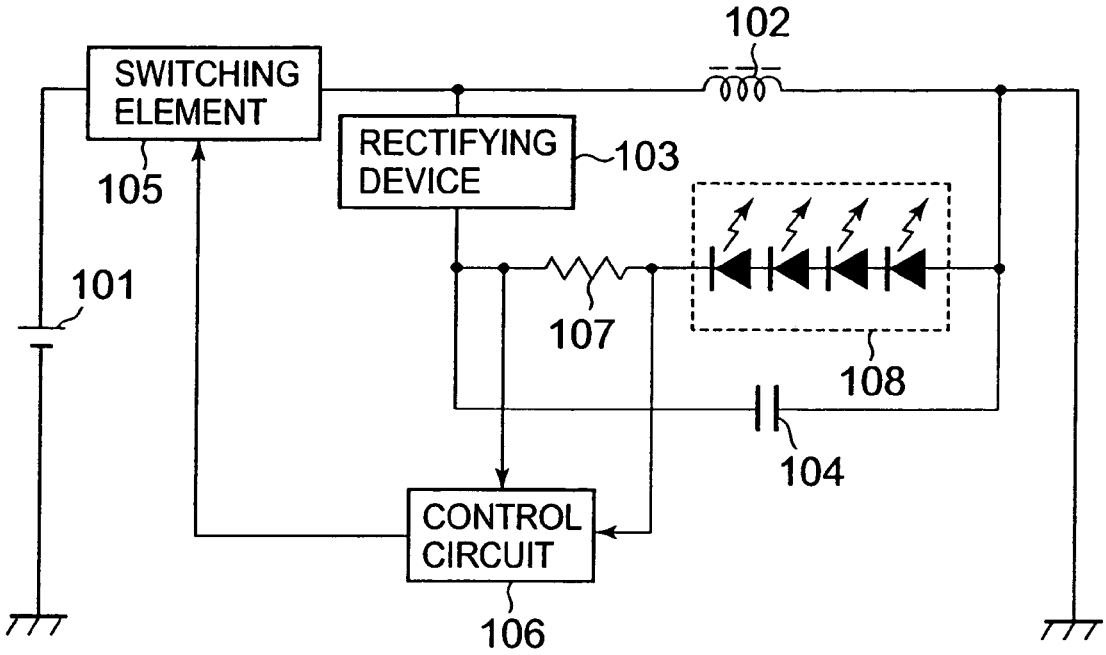
FIG. 9 is a diagram showing an LED drive circuit according to an eighth embodiment of the present invention.

FIG. 9 is a circuit diagram according to an eighth embodiment of the present invention. The eighth embodiment is different from the fourth embodiment in a position in which the switching element 105 is inserted. That is, the switching element 105 is inserted between the power supply 101 and a connecting point at which the inductor 102 and the smoothing capacity 104 are connected to each other.

The circuit according to the eighth embodiment has a configuration in which the ground is connected to one terminal of the inductor 102, the other terminal of the inductor 102 is connected to one terminal of the rectifying device 103, the other terminal of the rectifying device 103 is connected to one terminal of the smoothing capacity 104, and the other terminal of the smoothing capacity 104 is connected to the ground. The power supply 101 is connected to one terminal of the switching element 105, the other terminal of the switching element 105 is connected to a connecting point at which the inductor 102 and the rectifying device 103 are connected to each other. In the switching element 105, short-circuiting and open-circuiting are repeated, thereby causing the inductor 102 to charge/discharge electric power to cause the smoothing capacity 104 to generate a voltage through the rectifying device 103. Further, a connecting point between the inductor 102 and the smoothing capacity 104 is connected to one terminal of the LED 108, the other terminal of the LED 108 is connected to one terminal of the current sense element 107, the other terminal of the current sense element 107 is connected to a connecting point at which the rectifying device 103 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 9 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Ninth Embodiment

Figure 10:
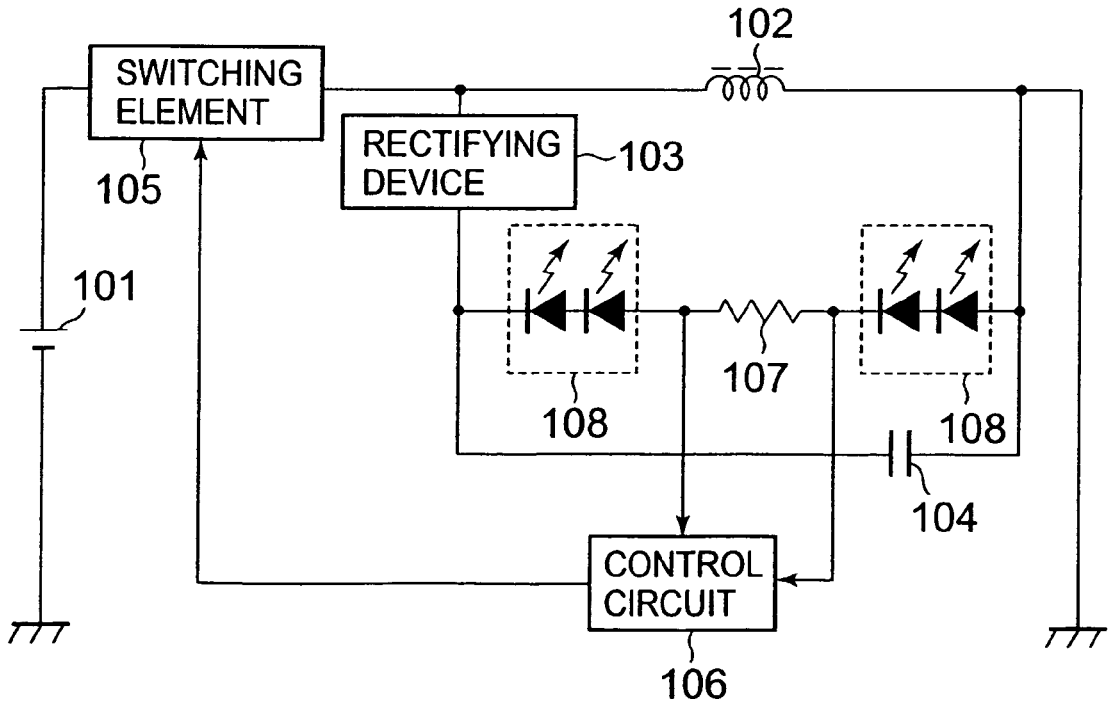
FIG. 10 is a diagram showing an LED drive circuit according to a ninth embodiment of the present invention.

FIG. 10 is a circuit diagram according to a ninth embodiment of the present invention. The ninth embodiment is different from the sixth embodiment in a position in which the switching element 105 is inserted. That is, the switching element 105 is inserted between the power supply 101 and a connecting point at which the inductor 102 and the smoothing capacity 104 are connected to each other.

The circuit according to the ninth embodiment has a configuration in which the ground is connected to one terminal of the inductor 102, the other terminal of the inductor 102 is connected to one terminal of the rectifying device 103, the other terminal of the rectifying device 103 is connected to one terminal of the smoothing capacity 104, and the other terminal of the smoothing capacity 104 is connected to the ground. The power supply 101 is connected to one terminal of the switching element 105, the other terminal of the switching element 105 is connected to a connecting point at which the inductor 102 and the rectifying device 103 are connected to each other. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the inductor 102 and the smoothing capacity 104 are connected to each other, is connected to one terminal of one of the LEDs 108, the other terminal of one of the LEDs 108 is connected to one terminal of the current sense element 107, the other terminal of the current sense element 107 is connected to one terminal of the other of the LEDs 108, and the other terminal of the other of the LEDs 108 is connected to a connecting point at which the rectifying device 103 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 10 resides in that both terminals of the inductor 102 and the rectifying device 103, which are connected in series to each other, are connected to both terminals of the smoothing capacity 104, and both terminals of the current sense element 107 and the LED 108, which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104 through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Tenth Embodiment

Figure 11:
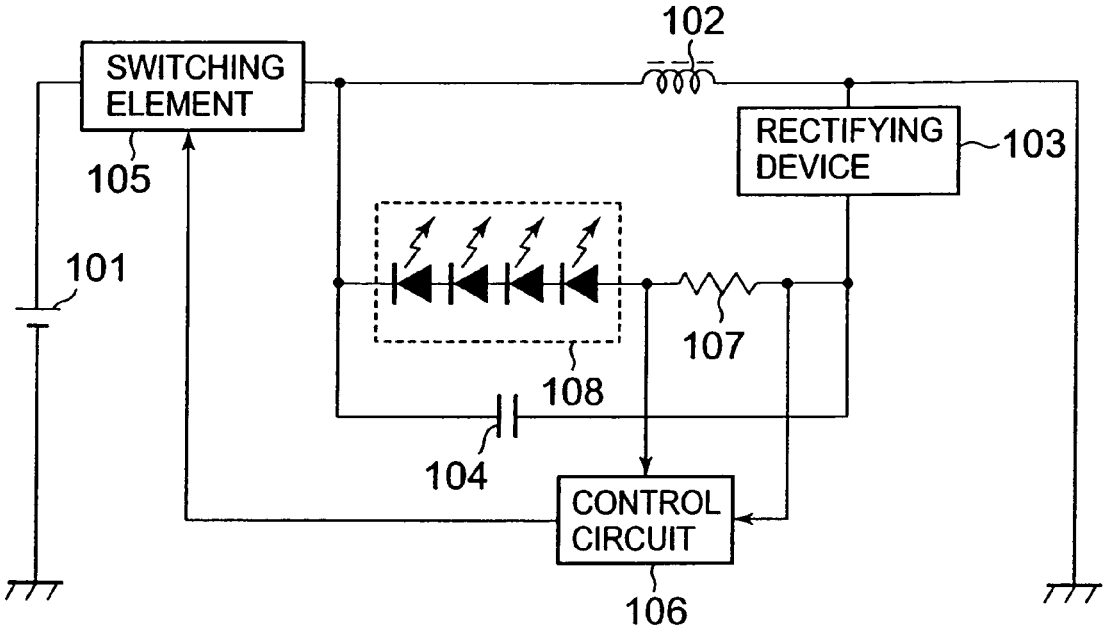
FIG. 11 is a diagram showing an LED drive circuit according to a tenth embodiment of the present invention.

FIG. 11 is a circuit diagram according to a tenth embodiment of the present invention. The tenth embodiment is different from the second embodiment in a position in which the switching element 105 is inserted. That is, the switching element 105 is inserted between the power supply 101 and a connecting point at which the inductor 102 and the smoothing capacity 104 are connected to each other.

The circuit according to the tenth embodiment has a configuration in which the ground is connected to one terminal of the inductor 102, the other terminal of the inductor 102 is connected to one terminal of the smoothing capacity 104, the other terminal of the smoothing capacity 104 is connected to one terminal of the rectifying device 103, and the other terminal of the rectifying device 103 is connected to the ground. The power supply 101 is connected to one terminal of the switching element 105, the other terminal of the switching element 105 is connected to a connecting point at which the inductor 102 and the smoothing capacity 104 are connected to each other. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the rectifying device 103 and the smoothing capacity 104 are connected to each other, is connected to one terminal of the current sense element 107, the other terminal of the current sense element 107 is connected to one terminal of the LED 108, the other terminal of the LED 108 is connected to a connecting point at which the inductor 102 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 11 resides in that the inductor 102 and the rectifying device 103 are connected in series to each other at each one terminal thereof, and the other terminals of the inductor 102 and the rectifying device 103 are connected to both terminals of the smoothing capacity 104, and to both terminals each of the current sense element 107 and the LED 108 which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104, through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a power current caused to flow through the current sense element 107, it is possible to cause a proper current to flow without making the LED 108 to emit light excessively.

Eleventh Embodiment

Figure 12:
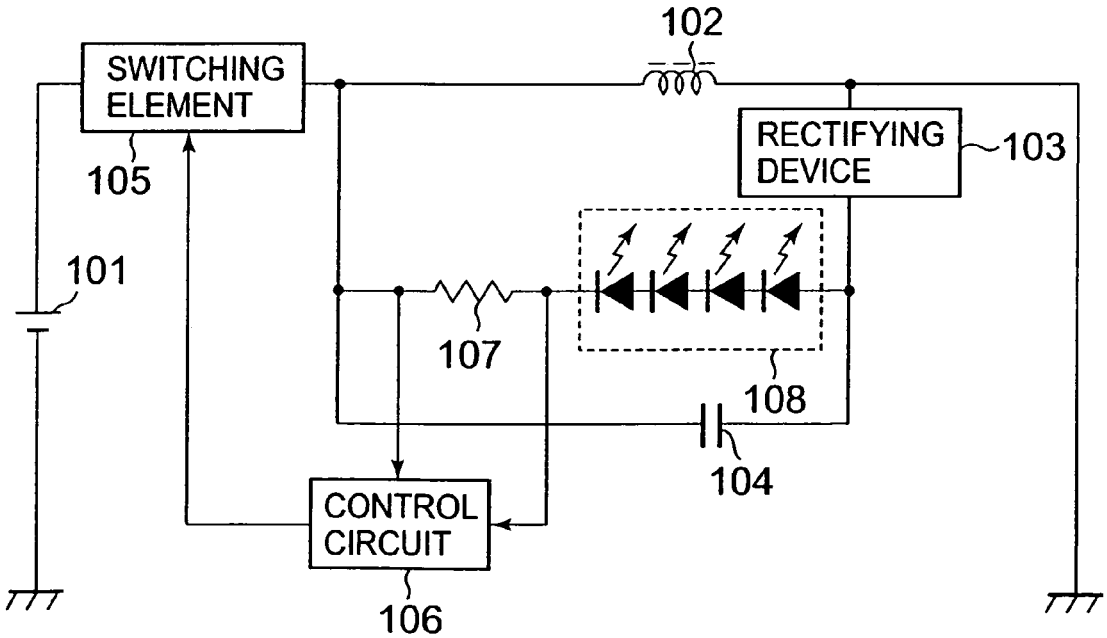
FIG. 12 is a diagram showing an LED drive circuit according to an eleventh embodiment of the present invention.

FIG. 12 is a circuit diagram according to an eleventh embodiment of the present invention. The eleventh embodiment is different from the first embodiment in a position in which the switching element 105 is inserted. That is, the switching element 105 is inserted between the power supply 101 and a connecting point at which the inductor 102 and the smoothing capacity 104 are connected to each other.

The circuit according to the eleventh embodiment has a configuration in which the ground is connected to one terminal of the inductor 102, the other terminal of the inductor 102 is connected to one terminal of the smoothing capacity 104, the other terminal of the smoothing capacity 104 is connected to one terminal of the rectifying device 103, and the other terminal of the rectifying device 103 is connected to the ground. The power supply 101 is connected to one terminal of the switching element 105, the other terminal of the switching element 105 is connected to a connecting point at which the inductor 102 and the smoothing capacity 104 are connected to each other. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the rectifying device 103 and the smoothing capacity 104 are connected to each other, is connected to one terminal of the LED 108, the other terminal of the LED 108 is connected to one terminal of the current sense element 107, the other terminal of the current sense element 107 is connected to a connecting point at which the inductor 102 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 12 resides in that the inductor 102 and the rectifying device 103 are connected in series to each other at each one terminal thereof, and therefore terminals of the inductor 102 and the rectifying device 103 are connected to both terminals of the smoothing capacity 104, and to both terminals each of the current sense element 107 and the LED 108 which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104, through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

Twelfth Embodiment

Figure 13:
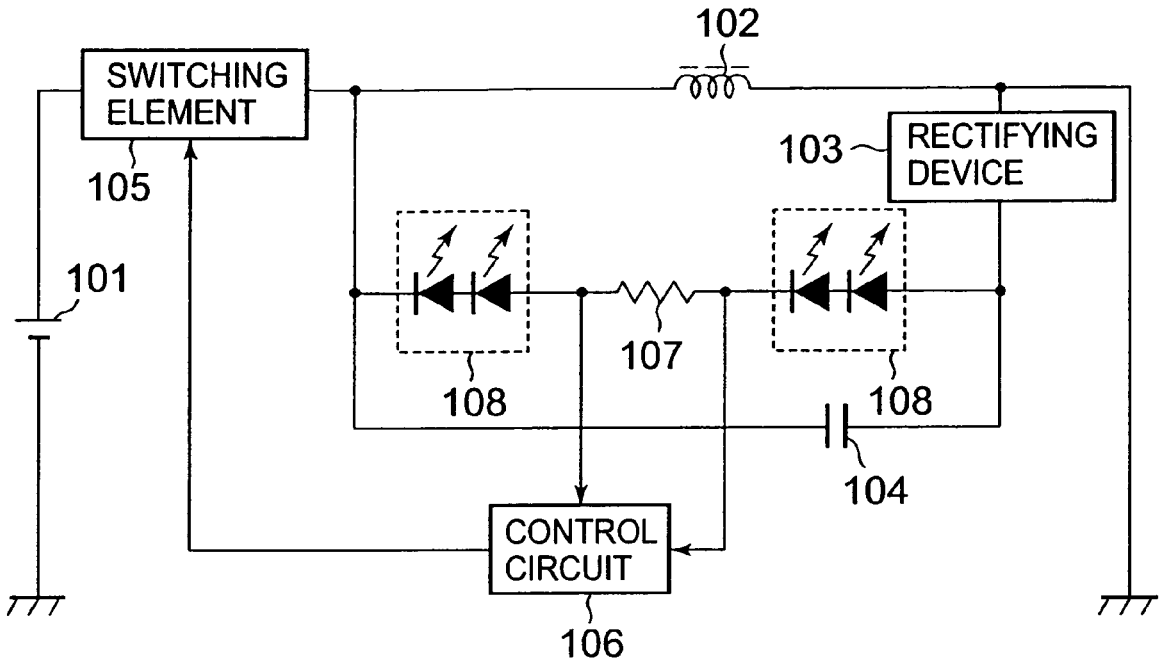
FIG. 13 is a diagram showing an LED drive circuit according to a twelfth embodiment of the present invention.

FIG. 13 is a circuit diagram according to a twelfth embodiment of the present invention. The twelfth embodiment is different from the third embodiment in a position in which the switching element 105 is inserted. That is, the switching element 105 is inserted between the power supply 101 and a connecting point at which the inductor 102 and the smoothing capacity 104 are connected to each other.

The circuit according to the twelfth embodiment has a configuration in which the ground is connected to one terminal of the inductor 102, the other terminal of the inductor 102 is connected to one terminal of the smoothing capacity 104, the other terminal of the smoothing capacity 104 is connected to one terminal of the rectifying device 103, and the other terminal of the rectifying device 103 is connected to the ground. The power supply 101 is connected to one terminal of the switching element 105, the other terminal of the switching element 105 is connected to a connecting point at which the inductor 102 and the smoothing capacity 104 are connected to each other. In the switching element 105, short-circuiting and open-circuiting are repeated, thereby causing the inductor 102 to charge/discharge electric power to cause the smoothing capacity 104 to generate a voltage through the rectifying device 103. Further, a connecting point at which the rectifying device 103 and the smoothing capacity 104 are connected to each other, is connected to one terminal of one of the LEDs 108, the other terminal of one of the LEDs 108 is connected to one terminal of the current sense element 107, the other terminal of the current sense element 107 is connected to one terminal of the other one of the LEDs 108, the other terminal of the other one of the LEDs 108 is connected to a connecting point at which the inductor 102 and the smoothing capacity 104 are connected to each other, thereby making it possible to drive the LED 108 at a voltage generated in the smoothing capacity 104. Further, the control circuit 106 is connected to both terminals of the current sense element 107, and a timing of short-circuiting and open-circuiting of the switching element 105 is adjusted in the control circuit 106, thereby making it possible to control a current flowing through the LED 108 at a proper value to cause the LED to emit light properly.

A feature of a configuration of FIG. 13 resides in that the inductor 102 and the rectifying device 103 which are connected in series to each other at each one terminal thereof, and the other terminals of the inductor 102 and the rectifying device 103 are connected to both terminals of the smoothing capacity 104, and to both terminals each of the current sense element 107 and the LED 108 which are connected in series to each other, in parallel with each other. With such the configuration, when the switching element 105 is short-circuited and the inductor 102 is charged with electric power, and then the switching element 105 is open-circuited and electric power is discharged from the inductor 102, the inductor 102 emits electric power directly to the current sense element 107, the LED 108, and the smoothing capacity 104, through the rectifying device 103, thereby making it possible to drive the LED 108 irrespective of the voltage of the power supply 101.

Therefore, with such the configuration, assuming that a voltage generated in the rectifying device 103 is set to 0 V, even when a voltage of a power supply 101 is higher than a sum of a forward voltage generated due to a proper current caused to flow through the LED 108 and a voltage generated due to a proper current caused to flow through the current sense element 107, it is possible to cause a proper current to flow without making the LED 108 to emit light excessively.

What is claimed is:

1. A light emitting diode drive circuit comprising:

an inductor having a first terminal connected to a power supply and a second terminal;

a light emitting diode section comprises a plurality of light emitting diodes and a current sense element connected in series, which is connected between the first terminal and the second terminal of the inductor;

a capacity connected in parallel with the light emitting diode section;

a switching element connected between the second terminal of the inductor and the ground;

a switching element control circuit for monitoring a voltage across both terminals of the current sense element and opening/closing the switching element; and a rectifying device connected between one of the first terminal and the second terminal of the inductor and the light emitting diode section.

2. A light emitting diode drive circuit according to claim 1, the light emitting diode section comprises a first light emitting diode section and a second light emitting diode section, wherein the current sense element is connected between the first light emitting diode section and the second light emitting diode section.

3. A light emitting diode drive circuit comprising:

a switching element having a first terminal connected to a power supply and a second terminal;

an inductor connected having a first terminal connected to the second terminal of the switching element and a second terminal connected to the ground;

a light emitting diode section comprises a plurality of light emitting diodes and a current sense element connected in series, which is connected between the first terminal and the second terminal of the inductor;

a capacity connected in parallel with the light emitting diode section;

a switching element control circuit for monitoring a voltage across both terminals of the current sense element and opening/closing the switching element; and a rectifying device connected between one of the first terminal and the second terminal of the inductor and the light emitting diode section.

4. A light emitting diode drive circuit according to claim 3, the light emitting diode section comprises a first light emitting diode section and a second light emitting diode section, wherein the current sense element is connected between the first light emitting diode section and the second light emitting diode section.

* * * * *